US009187929B2

(12) United States Patent
Webb et al.

(10) Patent No.: US 9,187,929 B2
(45) Date of Patent: Nov. 17, 2015

(54) ELECTRONIC CABINET/DRAWER LOCK SYSTEM

(75) Inventors: Michael A. Webb, Cave Creek, AZ (US); Scott P. Sullivan, Glendale, AZ (US); Francisco Figueroa-Del Pozo, Scottsdale, AZ (US); Andrew Lee Wilding, Phoenix, AZ (US); Joshua T. Peabody, Phoenix, AZ (US); Dominik Scheffler, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 608 days.

(21) Appl. No.: 13/618,425

(22) Filed: Sep. 14, 2012

(65) Prior Publication Data

US 2013/0067969 A1 Mar. 21, 2013

Related U.S. Application Data

(60) Provisional application No. 61/536,013, filed on Sep. 18, 2011.

(51) Int. Cl.
*E05B 47/06* (2006.01)
*E05B 47/00* (2006.01)
*E05B 65/52* (2006.01)

(52) U.S. Cl.
CPC ..... *E05B 47/00* (2013.01); *E05B 65/52* (2013.01); *E05B 47/0607* (2013.01); *Y10T 70/5097* (2015.04)

(58) Field of Classification Search
CPC ..... E05B 47/00; E05B 47/06; E05B 65/52; E05B 47/0607; Y10T 70/5097
USPC ..... 70/190, 277, 279.1, 278.1, 278.2, 70/278.3, 278.7, 280–283, 283.1; 292/142, 144
See application file for complete search history.

(56) References Cited

U.S. PATENT DOCUMENTS

| | | | | | |
|---|---|---|---|---|---|
| 2,219,186 | A | * | 10/1940 | Hornfeck | 292/144 |
| 3,872,696 | A | * | 3/1975 | Geringer | 70/145 |
| 4,438,962 | A | * | 3/1984 | Soloviff et al. | 292/144 |
| 4,633,688 | A | * | 1/1987 | Beudat et al. | 70/279.1 |
| 4,904,005 | A | * | 2/1990 | Frolov | 292/251.5 |
| 4,986,099 | A | * | 1/1991 | Johnson et al. | 70/277 |
| 5,280,881 | A | * | 1/1994 | Karmin | 70/279.1 |
| 5,346,266 | A | * | 9/1994 | Bisbing | 292/64 |
| 5,626,039 | A | * | 5/1997 | Solari et al. | 70/279.1 |
| 5,791,179 | A | * | 8/1998 | Brask | 70/278.1 |
| 5,857,365 | A | * | 1/1999 | Armstrong | 70/279.1 |
| 5,925,861 | A | * | 7/1999 | Fromberg | 200/61.67 |
| 5,987,945 | A | * | 11/1999 | Ruano Aramburu | 70/277 |

(Continued)

*Primary Examiner* — Lloyd Gall
(74) *Attorney, Agent, or Firm* — Woods Oviatt Gilman, LLP; Ronald J. Kisicki, Esq.

(57) ABSTRACT

An electronic wireless locking system comprising an external assembly and an internal assembly disposable on respective sides of a door or drawer. The external assembly includes a cover housing, a knob having a shaft, a card/credential reader, a status indicator, a wireless communication capability, a wire harness and a jump port plug. The internal assembly comprises a rotation link matable with the external shaft, a latch bolt, a circuit board and controller, and a locking mechanism including a rack and pinion gear set linking the rotation link with the latch bolt. A blocker inhibits the latch bolt from unlocking until authorized to rotate 90°, permitting the latch bolt to be withdrawn from a strike plate by manual rotation of the knob. An optional mechanical key override feature may also be provided. The system may further include a preload sensor and a device locked sensor.

15 Claims, 6 Drawing Sheets

(56) References Cited

U.S. PATENT DOCUMENTS

| | | | | |
|---|---|---|---|---|
| 6,418,763 | B1 * | 7/2002 | Huang | 70/278.7 |
| 7,096,697 | B2 * | 8/2006 | Keightly | 70/279.1 |
| 7,313,937 | B2 * | 1/2008 | Straka, Jr. | 70/137 |
| 7,484,391 | B1 * | 2/2009 | Moore | 70/257 |
| 8,621,900 | B2 * | 1/2014 | Wu et al. | 70/280 |
| 2005/0044908 | A1 * | 3/2005 | Min | 70/276 |
| 2006/0238294 | A1 * | 10/2006 | Gokcebay et al. | 340/5.54 |
| 2008/0236214 | A1 * | 10/2008 | Han | 70/129 |
| 2011/0203331 | A1 * | 8/2011 | Picard et al. | 70/91 |
| 2012/0073338 | A1 * | 3/2012 | Mohla | 70/124 |
| 2012/0167646 | A1 * | 7/2012 | Sharma et al. | 70/280 |
| 2012/0313383 | A1 * | 12/2012 | Lundberg et al. | 292/144 |
| 2013/0031940 | A1 * | 2/2013 | Romero | 70/278.1 |

* cited by examiner

ELECTRONIC CABINET/DRAWER LOCK SYSTEM

This application claims the benefit of U.S. Provisional Application No. 61/536,013, filed Sep. 18, 2011.

TECHNICAL FIELD

The present invention relates to electronically-controlled lock systems, and also to cabinet latches; more particularly, to a system for securely latching a cabinet/locker door or drawer with an electronic lock mechanism; and most particularly, to a battery-powered electronic lock system responsive to a card reader or other authorization means, suitable for securely latching of a cabinet/locker door or drawer.

BACKGROUND OF THE INVENTION

Locking systems for securing cabinet/locker doors and drawers are well known in the prior art. Typically, such a system may comprise a simple spring latch actuated by manual turning of a key in an associated barrel lock.

More sophisticated door locking security systems are known wherein an electro-mechanical latching apparatus may be actuated by a card reader or key pad. The electromechanical mechanism is known to be mounted on either the cabinet/locker door or drawer or within the frame surrounding the cabinet/locker door or drawer. In either embodiment, the latching mechanism is actuated by a linear solenoid or small DC motor powered by an external DC supply, which is difficult for either a door-latching or drawer-latching application wherein the locking mechanism is mounted on the movable member.

Many prior art devices cannot easily be installed to engage with a mating part located above or to the side of the movable member. Most devices in the prior art cannot communicate with a centrally located access control system in a wireless mode. None of the prior art units have the capability of delaying the unlock signal until any preload on the release mechanism has been removed. In that case, the person trying to get into the cabinet or drawer would have to re-enter their code or re-swipe their card after the preload had been removed.

Also, none of the prior art devices have the ability to sense the presence of the locking member in its mating part which is mounted in the top or side wall of the cabinet. Finally, few if any prior art devices have a mechanical key override.

What is needed in the art is an electronic cabinet/locker lock system wherein the mechanism and circuitry are powered only by resident batteries which can be recharged by inductive power transfer, and the system can communicate wirelessly with a remote access control system.

Additionally, the art needs a lock which can be mounted in any of four positions relative to the door/drawer and frame; can sense a preload condition and delay the activation signal until the preload has been removed; sense the presence of the locking member in its locked position; and provide a key override.

It is a principal object of the present invention to securely lock a cabinet/locker door or drawer, and to make such a locking apparatus releasable by card reader or a keypad. Additionally, this lock system could be used on standard entry doors.

SUMMARY OF THE INVENTION

Briefly described, a wireless battery operated locking system in accordance with the present invention comprises a first ("external") assembly disposable on the outside of a cabinet/locker door or drawer and a second ("internal") assembly disposable on the inside of the cabinet/locker door or drawer.

The external assembly comprises an external cover housing; a rotatable knob having a rectangular shaft extendable through the door or drawer face to mate with the internal assembly; a card/credential reader; a status indicator; a wireless capability to communicate with a remote control center; a wire harness for connecting to the internal assembly; and a jump port plug and cap.

The internal assembly comprises a housing; a shaft rotation link matable with the external knob shaft; a latch bolt assembly connected to the shaft rotation link; a battery-powered circuit board and controller; a battery-powered locking and unlocking mechanism, a mechanical key override feature, a unit locked sensing feature, a preload sensing feature and a battery.

The battery powered locking mechanism includes a rack and pinion gear set linking the shaft rotation link with a latch sleeve supporting the latch bolt. A rotatable blocker inhibits motion of the latch sleeve unless such motion is authorized by the external card/credential reader. Upon such authorization, a battery-powered motor, such as a DC motor, a piezo motor or a linear piezo actuator rotates the blocker 90°, or otherwise linearly displaces the blocker, thereby permitting the latch bolt to be withdrawn from latched engagement with a jamb-mounted strike plate by manual rotation of the knob, shaft, shaft rotation link, and pinion gear (all through a bearing located in the internal module).

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
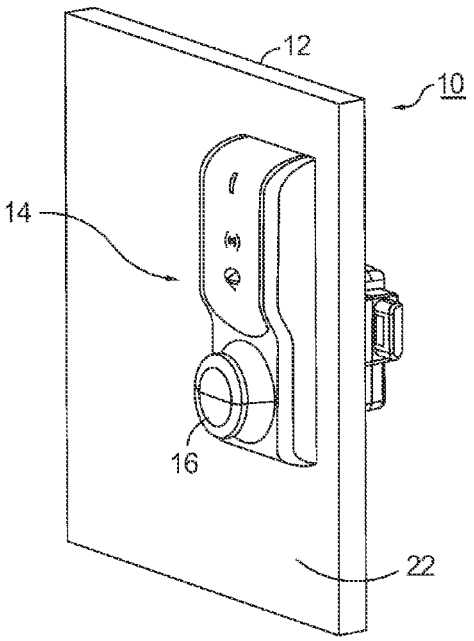
FIG. 1 is an isometric drawing taken from the front, showing a wireless battery operated locking system in accordance with the present invention mounted to a cabinet/locker door.
Figure 2:
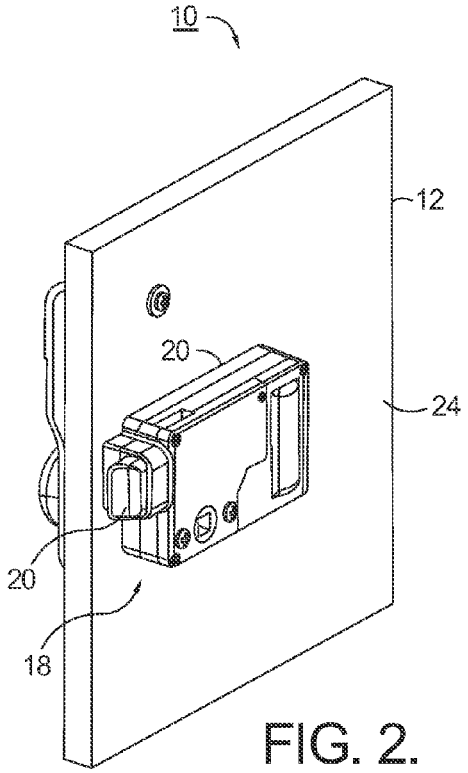
FIG. 2 is an isometric drawing taken from the rear of the system shown in FIG. 1.
Figure 4:
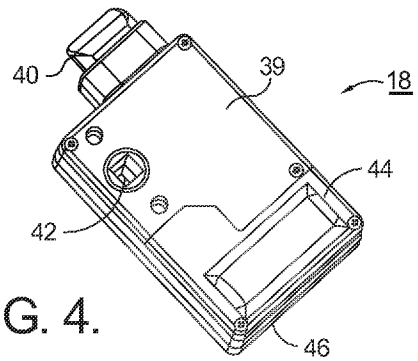
FIG. 4 is a first isometric view of an internal assembly of the system shown in FIG. 1.
Figure 5:
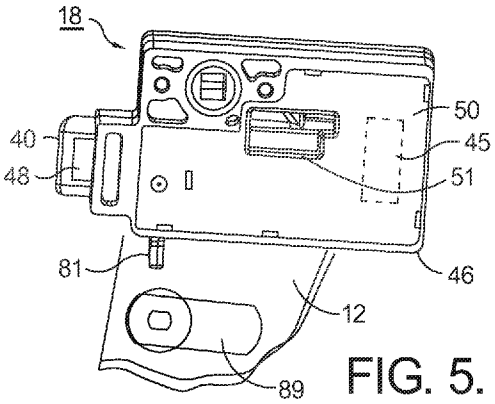
FIG. 5 is a second isometric view that is the obverse of the view shown in FIG. 4.
Figure 3:
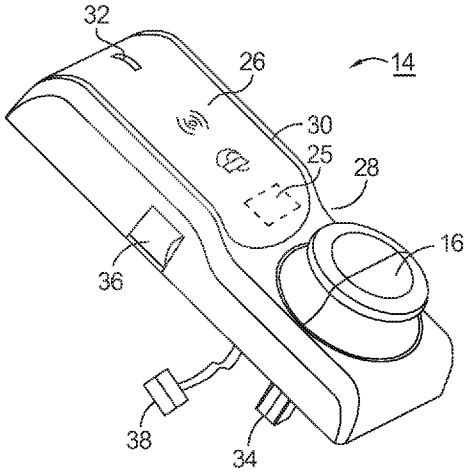
FIG. 3 is an isometric view of an external assembly of the system shown in FIG. 1.

There exists the need for a wireless battery operated locking system that has a spring latch mechanism which automatically locks a cabinet/locker door or drawer when pushed closed. The system must also be able to change to an unlocked state when the system's card reader is presented with valid credentials. Additionally, the system must support being surface-mounted on either a cabinet/locker door or a drawer front face, configured in any of four positions. These positions are in axial rotation about the knob with minimum intervals of 90°, as shown and described more fully below in FIGS. 6 through 8.

Referring to FIGS. 1 through 5, a general layout is shown for a wireless battery operated locking system 10 for locking a cabinet or locker door or drawer 12 (all referred to herein below as "cabinet door") in accordance with the present invention.

System 10 includes external assembly 14, including a rotatable knob 16 and internal assembly 18 including a battery-operated locking mechanism 20 mounted on respective outer and inner surfaces 22, 24 of cabinet door 12. An optical or magnetic card/credential reader 26 is disposed in external housing cover 28, with card/credential reader antenna 30, status indicator 32, knob 16 and attached shaft 34, and a jump port plug cap 36. A jump port plug, hidden by the jump port plug cap 36, addresses the issue of occasional low battery power. The jump port is available to apply emergency external power to the system. A wiring harness 38 for connection to internal assembly 18 is connected to a circuit board 25, reader 26, antenna 30, status indicator 32, and a jump port (not visible) under cap 36. Antenna 30 communicates with a hub connected to a remote access control system (not shown).

Battery-powered locking mechanism 20 comprises cover housing 39, latch bolt 40, shaft rotation link 42, battery cover 44, housing or case 46, sensor switch cover 48, security board cover 50, a small motor assembly 84 (Shown in FIG. 11); a circuit board 45 which includes a processor for conducting encrypted communication with external assembly 14; a motor driver; and a battery. There is a switch in the circuit board 45 which monitors the position of the latch bolt sleeve to detect if there is a preload on the knob, as described in detail below.

Wiring harness 38 connects the external and internal assemblies 14, 18 so that they can communicate with each other and so that electronics in the external assembly can be powered by the battery. Wiring harness 38 is affixed to the external assembly; during installation, harness 38 is fed through a hole in cabinet door 12 then the external assembly is installed on the cabinet door front 22. Wiring harness 38 is then plugged into the internal assembly which then is installed on the inside surface 24 of cabinet door 12. Alternatively, the wiring harness 38 is fed through a through-gap 51 within the internal assembly, with the internal assembly then secured to the inside surface 24 of the cabinet before connecting the wire harness to the internal assembly.

Figure 6:
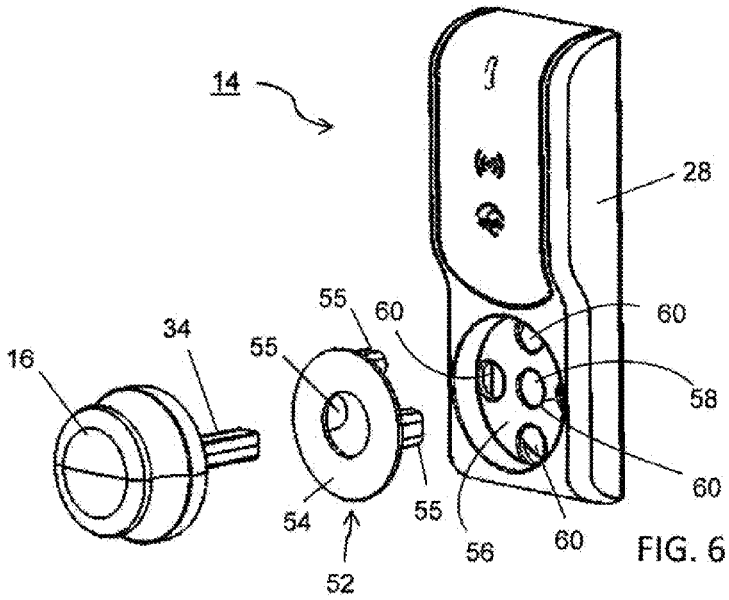
FIG. 6 is a partially exploded isometric view of the external assembly shown in FIG. 3.
Figure 7:
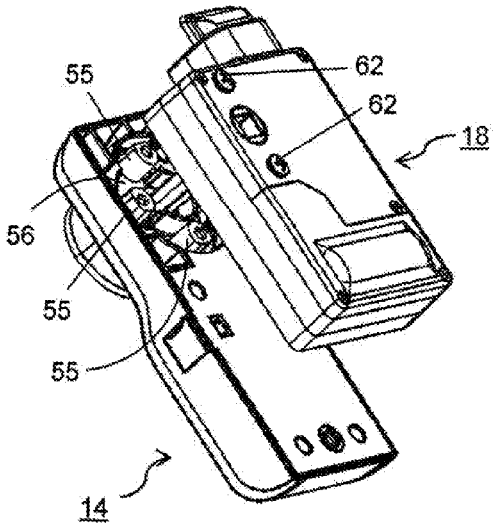
FIGS. 7 and 8 are two isometric views showing alternate assembly orientations between the external and internal assemblies.
Figure 8:
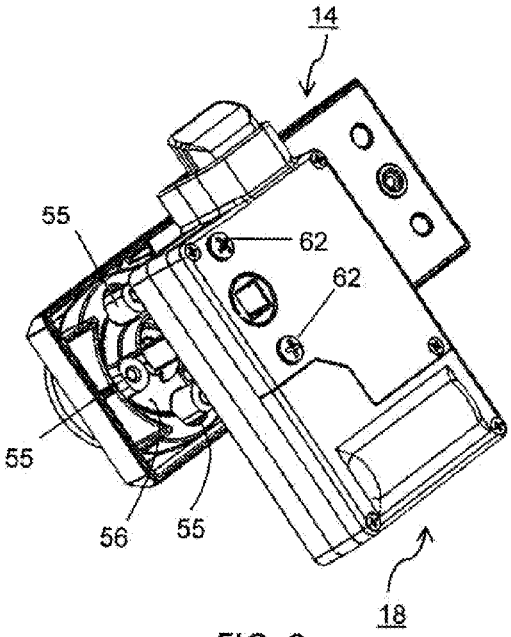

Referring to FIGS. 6 through 8, a sequence is shown for changing the relative orientation between external assembly 14 and internal assembly 18, as may be required for any cabinet door, locker door, and drawer application, to accommodate door/drawer handing and top or side locking. This is an important advantage of the present invention. Attachment/follower ring 52 includes a flat ring portion 54 having at least two molded nut platforms 55 extending rearward there from. In the case of two nut platforms 55, the platforms are spaced 180° apart, while a ring portion having four molded nut platforms 55 has platforms spaced 90° apart. Housing 28 includes a shallow well 56 having a central opening 58 for passage of shaft 34 there through and four openings 60 disposed quadrilaterally for receiving in opposed pairs platforms 55 to mate with mounting screw holes 62 in internal assembly 18. As shown in FIGS. 7 and 8, this arrangement of platforms 55 and openings 60 allows an installer to configure external and internal assemblies 14, 18 in any of four different positions rotated about knob 16 in increments of 90°. Two such positions are shown in FIGS. 7 and 8.

Figure 9:
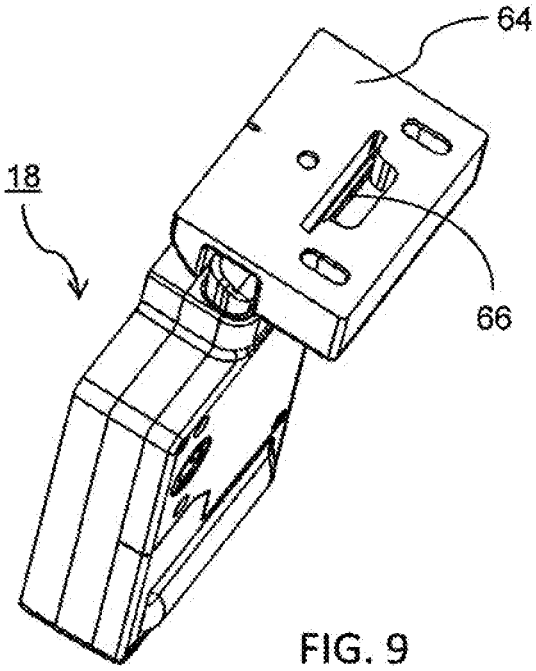
FIGS. 9 and 10 are two isometric views of the internal assembly showing its relationship to a magnet-equipped strike plate when the lock system is closed.
Figure 10:
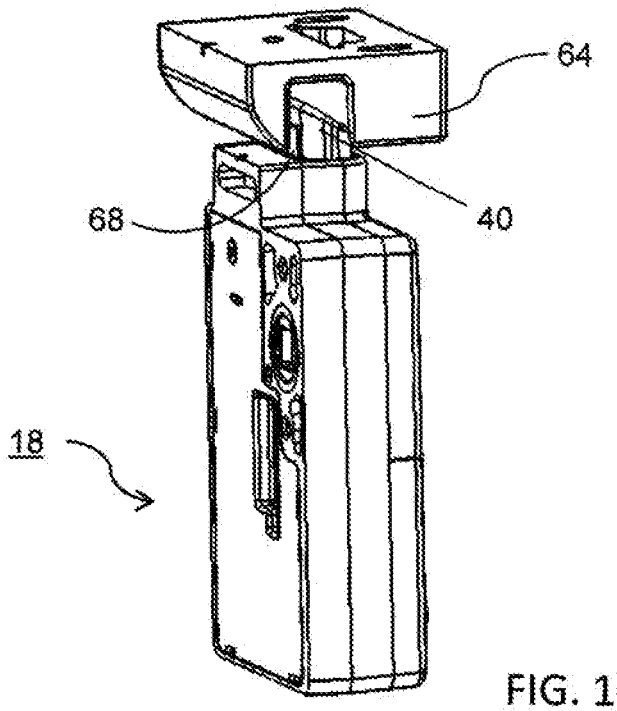

Referring to FIGS. 9 and 10, a jamb-mounted strike plate 64 includes a magnet 66 that activates reed-switch sensor 68 embedded in latch bolt 40, allowing system 10 to detect if cabinet door 12 is fully closed and the lock mechanism is in locked position. In certain embodiments, the strike plate's magnet is placed within the strike plate distal the latch bolt so as to minimize or prevent false readings by the sensor when the door is open.

Figure 11:
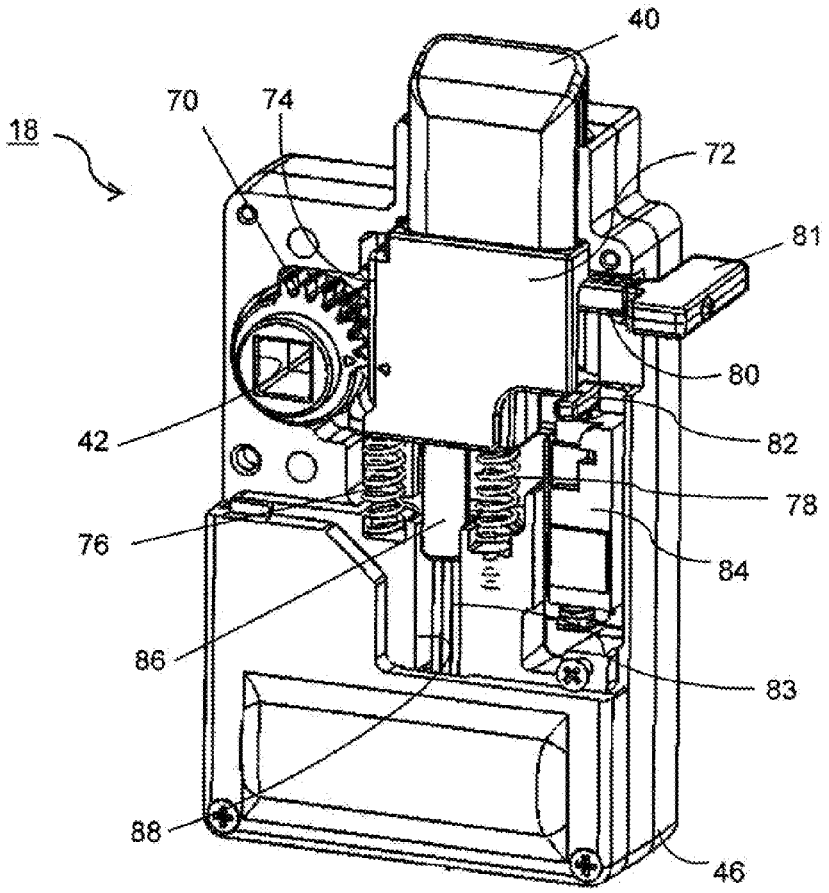
FIG. 11 is an isometric view similar to that shown in FIG. 4 but having the cover removed for clarity.

FIG. 11 shows components and operating relationships of a partially exposed internal structure of locking mechanism 18. Pinion gear 70 is linked to shaft rotation link 42 and rotates 45° to move lock bolt sleeve 72 via an integral rack gear 74 to the home position at locked state, driven by sleeve return spring 76. Pinion gear 70, when driven by manual rotation of knob 16 and shaft 34, moves sleeve 72 down to the unlocked position, bringing with it latch bolt 40. The returning force for latch bolt 40 is provided by spring 78. Connecting arm 80, fixed to latch bolt 40, links sleeve 72 and latch bolt 40 when gear 70 is activated, forcing sleeve 72 and latch bolt 40 to move together to the unlocked position. Connecting arm 80 also keeps latch bolt 40 from being removed from the assembly.

A blocker 82 attached to motor assembly 84 prevents sleeve 72 from being moved to the unlocked position by rotation of gear 70, as shown in FIG. 11. Thus, with blocker 82 in place as shown, latch bolt 40 is held in a locked position. Upon application of valid credentials to external assembly 14, motor assembly 84 is energized and blocker 82 is rotated 90° to get out of the path of sleeve 72 at unlock position. This allows sleeve 72 and latch bolt 40 to move, powered by manual rotation of knob 16, so that latch bolt 40 ends up recessed into internal assembly 18 and cabinet door 12 can be opened.

Referring again to FIGS. 5 and 11, a mechanical key override feature is provided permitting manual movement of latch bolt 40 to an unlocked position while sleeve 72 is held by blocker 82 in a locked position. Extension 81 of connecting arm 80 projects laterally from latch bolt 40 and passes through clearance slots in sleeve 72 and housing cover 39. A conventional, key operated cam lock 89 (key side of the cam lock not shown) mounted in door 12 adjacent extension 81 may be used to mechanically move connecting arm 80 and latch bolt 40 to an unlocked position upon rotation of the key operated cam lock in the event of a power failure to motor assembly 84. Extension 81 may be omitted in applications where a mechanical override feature is not needed.

A cylindrical feature 86 on latch bolt 40 allows the reed switch wires 83 to pass through it, making them concealed and protected while latch bolt 40 moves up and down. Channel 88 in case 46 allows freedom of movement of the wires inside the channel and for the wires to stay connected to a secure board therein (not visible) while latch bolt 40 moves. Channel 88 further functions as a guide, in conjunction with cylindrical feature 86, to limit side to side movement of the latch bolt as the latch bolt moves up and down.

Figure 12:
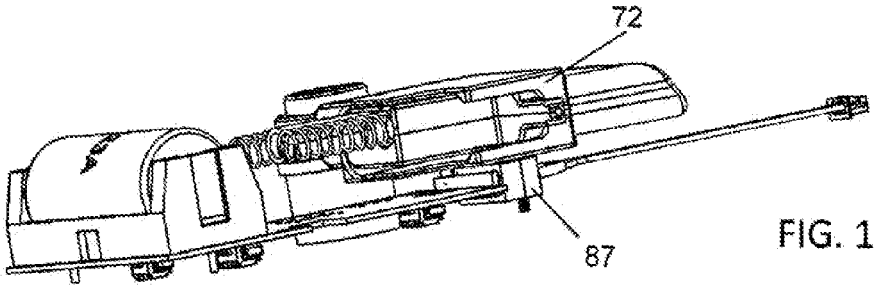
FIG. 12 is a partially exploded isometric view of a portion of the internal assembly, showing the pre-load sensing switch.

Referring to FIG. 12, a knob rotation switch 87 allows system 10 to confirm that no pressure is being applied to turn knob 16 when a valid card/credential is presented to reader 26. This prevents a preload from being applied to blocker 82 which could prevent the blocker from releasing the sleeve upon motor activation. If a person tries to anticipate the unlocking of the mechanism by trying to rotate knob 16, switch 87 opens and prevents motor assembly 84 from trying to rotate blocker 82. Switch 87 must always be depressed by the sleeve 72 when a valid card/credential is presented to allow activation of motor assembly 84 and rotation of blocker 82 to unlock the mechanism, as described above. Switch 87 is mounted onto internal assembly 18 and is acted upon by a movement of sleeve 72 upon initial rotation of turn knob 16, such that when the latch 40 is resting and locked, the position of sleeve 72 depresses switch 87 completing the circuit to the motor.

In one aspect of the invention, in the case where a premature turning of the knob is followed by an unlock signal from a presentation of the card/credential, the unlock signal to the motor may be stored and applied at a later time once the turn knob pressure is released. In the case of the turn knob having pressure applied when the motor assembly is attempting to relock the unit, the relock signal may also be stored until the pressure has been released from the turn knob. This is particularly important to make certain that the lock has been re-locked and the door or drawer thus secured.

Figure 13:
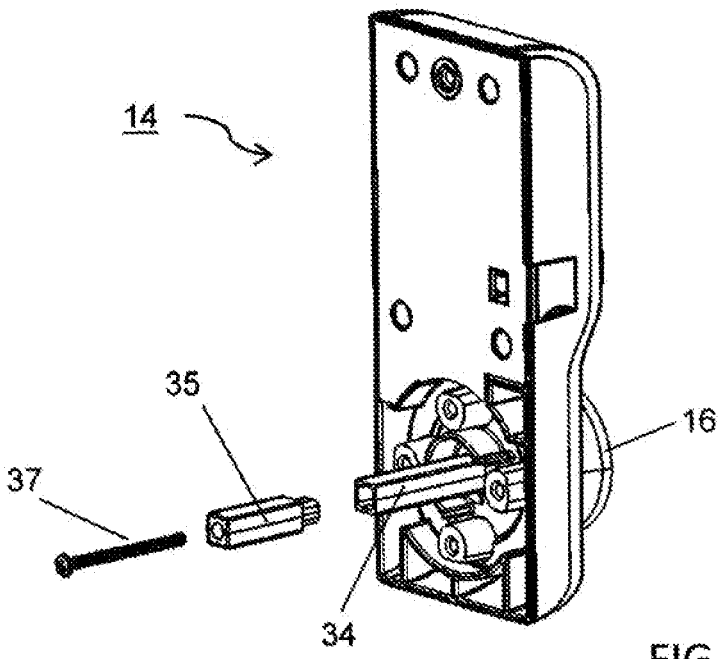
FIGS. 13 and 14 are two isometric views of the rear of the external assembly, showing an extended shaft.
Figure 14:
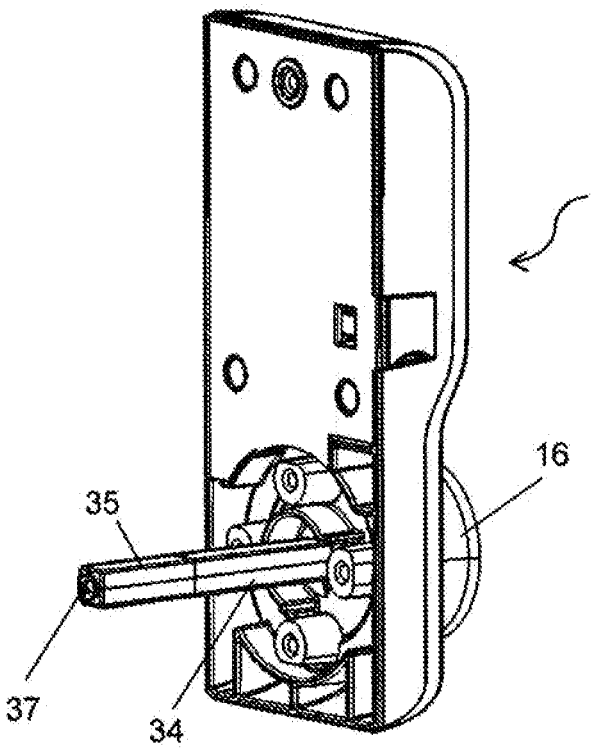

Referring now to FIGS. 13 and 14, depending upon the thickness of the door or panel, shaft 34 protruding rearwardly from external assembly 14 may be further lengthened by provision of shaft extension 35. Shaft extension 35 is adapted to have a first end snuggly fit within the through bore of shaft 34. A bolt 37 is then threaded through the shaft extension 35 and secured within shaft 34. Thus, the extended shaft mates with and engages shaft link 42 within the internal assembly upon rotation of knob 16.

In operation of system 10, when a security card is held up to the reader, the reader sends the card information wirelessly, such as by way of antenna 30 to a remote hub which asks an access control system if the card is valid. The remote hub replies to the cabinet lock system with the validation signal as reported by the access control system. If the card is valid, the external assembly 14 sends an encrypted data packet to the internal assembly, which decodes it and drives motor assembly 84 to unlock the latch. After a set period of time, the latch is relocked by driving motor assembly 84 in an opposite direction.

The circuit board 45 in the internal assembly constantly monitors the switch mounted in the latch bolt to determine if the cabinet door is closed and reports this status back to the circuit board 25 in the external assembly so that the data can be sent to the access control system. The switch for detecting load on the knob is monitored only when the motor assembly 84 is trying to unlock or relock the device. If there is a pre-load on the knob, the system will wait until the knob is released before attempting to unlock or relock.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An electronic lock system for securely locking a door or drawer, comprising:

an external assembly mountable to an external surface of said door or drawer; and an internal assembly mountable to an internal surface within said door or drawer and electrically connectable to said external assembly, wherein said external assembly includes a first circuit board, a rotatable actuator and attached shaft, wherein said internal assembly includes a motor assembly, a second circuit board, a locking mechanism including a latch bolt and a latch bolt sleeve supportive of and operatively connected to said latch bolt wherein said latch bolt is movable relative to said latch bolt sleeve, a rotatable link for receiving said shaft and operatively connected to said latch bolt sleeve, and a blocker operatively connected to said motor assembly and rotatable by said motor assembly between a blocking position wherein said latch bolt sleeve is blocked from movement and a non-blocking position wherein said latch bolt sleeve is not blocked from said movement.

2. A system in accordance with claim 1 wherein said internal assembly further includes an actuator rotation switch, wherein said actuator rotation switch and said motor assembly are operatively connected to said second circuit board.

3. A system in accordance with claim 1 further comprising a card/credential reader and an antenna connected to said first circuit board.

4. A system in accordance with claim 1 further comprising an attachment between said external assembly and said internal assembly, wherein said external assembly may be positioned at any of a plurality of rotational orientations with respect to said internal assembly.

5. A system in accordance with claim 1 further comprising:

a strike plate associated with said internal assembly, wherein said strike plate includes a magnet; and a magnetically sensitive switch disposed in said latch bolt that provides a signal to said second circuit board indicative of a correct locking position of said latch bolt with respect to said strike plate.

6. A system in accordance with claim 5 wherein said magnetically sensitive switch is a reed switch.

7. A system in accordance with claim 1 wherein a rack and pinion gear set connects said rotatable link to said latch bolt sleeve.

8. A system in accordance with claim 7 further comprising a connecting arm operatively connecting said latch bolt sleeve to said latch bolt.

9. A system in accordance with claim 1 wherein said blocker is capable of rotation through about 90° between said blocking position and said non-blocking position.

10. A system in accordance with claim 9 further comprising a mechanical key override feature comprising a cam lock rotatable by a key, wherein said cam lock is configured to move said latch bolt relative to said latch bolt sleeve when said latch bolt sleeve is blocked from said movement.

11. A system in accordance with claim 10 wherein said latch bolt and said latch bolt sleeve move telescopically in a coordinated manner such that said latch bolt and said latch bolt sleeve move together or said latch bolt moves independently of said latch bolt sleeve, thereby permitting unlocking of said latch bolt by said mechanical key override feature.

12. A system in accordance with claim 1 further comprising a switch contactable by said latch bolt sleeve and movable by said latch bolt sleeve between a first switch position and a second switch position wherein, when said switch is in said second switch position, a signal is sent by said switch indicative of a preload on said rotatable actuator, and movement of said blocker said motor assembly is deferred until said preload is removed, and wherein, when said switch is in said first position, movement of said blocker by said motor assembly is not deferred.

13. A system in accordance with claim 1 wherein said internal assembly includes a battery for powering said motor assembly.

14. A system in accordance with claim 13 wherein said external assembly further comprises a port for attaching an external power source to power said motor assembly.

15. A system in accordance with claim 1 wherein said system is configured to transmit encrypted communications between said external assembly and said internal assembly.

* * * * *